United States Patent [19]

Kimura et al.

[11] 4,053,314

[45] Oct. 11, 1977

[54] AMINE DEVELOPER LIQUID FOR DIAZOTYPE REPRODUCTION

[75] Inventors: Masanori Kimura, Funabashi; Koji Irino, Kamakura, both of Japan

[73] Assignee: Kabushiki Kaisha Bunshodo, Tokyo, Japan

[21] Appl. No.: 601,539

[22] Filed: Aug. 4, 1975

[30] Foreign Application Priority Data

Aug. 9, 1974 Japan ..... 49-90713

[51] Int. Cl.[2] ..... G03C 5/34

[52] U.S. Cl. ..... 96/49; 252/117; 252/544; 252/DIG. 1

[58] Field of Search ..... 96/48 R, 49, 33, 91 R, 96/75; 252/117, 544, DIG. 1

[56] References Cited

U.S. PATENT DOCUMENTS

| | | | |
|---|---|---|---|
| 2,860,977 | 11/1958 | Tregillus | 96/49 |
| 3,130,051 | 4/1964 | Herrick et al. | 96/49 |
| 3,203,797 | 8/1965 | Muller | 96/49 |
| 3,446,620 | 5/1969 | Parker | 96/49 |
| 3,586,504 | 6/1971 | Coates et al. | 96/91 D |
| 3,654,166 | 4/1972 | Eckert et al. | 252/117 |
| 3,663,445 | 5/1972 | Augustin et al. | 252/117 |
| 3,669,660 | 6/1972 | Golda et al. | 96/49 |
| 3,733,281 | 5/1973 | Durfey et al. | 252/544 |
| 3,779,768 | 12/1973 | Cope et al. | 96/49 |
| 3,809,559 | 5/1974 | Neuman | 96/49 |

FOREIGN PATENT DOCUMENTS

| | | | |
|---|---|---|---|
| 1,339,085 | 11/1973 | Japan | 96/49 |

OTHER PUBLICATIONS

Guenther R.A. et al., I & E Chem., Prod. Res. & Dev., vol. 1, No. 3, Sept. 1962, pp. 165–169.

Bascom, W. D., "I & E Chem., Prod. Res. & Dev.," vol. 8, No. 2, June 1969, pp. 118–123.

Chem. Abstracts, vol. 80, Mar. 1974, No. 61388f.

*Primary Examiner*—Charles L. Bowers, Jr.

*Attorney, Agent, or Firm*—Neuman, Williams, Anderson & Olson

[57] ABSTRACT

On an apparatus for developing latent images of diazotype prints with a developer liquid containing an organic amine or amines as the developing agent, the tendency of the diazotype paper to curl and wind round the applicator roller is effectively precluded by the addition of a very small amount of a fluorocarbon nonionic surface active agent. The amount of the agent is preferably in the range from 0.01 to 1% of the total weight of the developer composition.

2 Claims, No Drawings

AMINE DEVELOPER LIQUID FOR DIAZOTYPE REPRODUCTION

BRIEF SUMMARY OF THE INVENTION

This invention relates to an amine developer liquid for diazotype reproduction. More particularly, the invention is concerned with a developer liquid for use in a modern method of development for diazotype reproduction which, unlike the wet or ammonia processes, comprises applying a very small amount of a developer liquid containing an organic amine or amines as the developing agent to two-component diazotype prints. The concept has recently been proposed, as shown in the published specifications of Japanese Pat. application Publication Nos. 23515/1970 and 24998/1969, and has already been commercially accepted.

A practical example of the new method will now be briefly stated.

An original based on a transparent or semitransparent paper or film is superposed with a diazo paper and fed together to a copying machine through its entrance. They first pass through a light-exposing zone for exposure and are separated. The exposed print is sent to a developing zone, where it is developed by coating with a very small amount of the developer liquid. The application of a very small amount of the developer, for example at a rate of 1 – 2 g/m², is accomplished in the following way. First, an applicator roller of rubber or the like having minute indentations on the surface is supplied with the developer liquid. A control member, such as a doctor blade or roller, is held against the roller surface to control the amount of the liquid thereon. Finally, the diazotype print is pressed against the roller surface by auxiliary means, such as a blade or roller, so that the developer liquid is transferred from the roller surface onto the print surface. Since the amount of the liquid thus transferred is very small, the developed print does not feel damp but dry.

The developing mechanism as described above has inherent problems yet to be solved for its practical applications. Because of the developer liquid present therebetween, the diazotype print in the course of development tends to stick to the applicator roller. Prints may curl and wind round the roller especially if they are thin. This phenomenon is intensified when the print feed rate is high, the viscosity of the developer liquid has increased due to prolonged use, the amount of the liquid to be controlled on the applicator roller during development is too large, or when the water content of the developer liquid has become excessive owing to absorption of water from atmospheric air. In the conventional wet process the developer liquid is employed in the form of an aqueous solution, and the amount of the liquid to be supplied to the print is, of course, by far the greater than in the method under consideration. Consequently, the phenomenon of the print winding round the developing roller is more often observed. In the wet process, therefore, it is generally in practice to provide several grooves on the surface of the roller, parallelly to its axis and set thin and narrow blades in the grooves so as to force away the paper that tends to wind round the roller. In the case of wet type operation, which supplies a large volume of liquid for the development purpose, such mechanical antiwinding means may be mounted without any adverse effect upon the development. In the method under consideration, however, the use of the same antiwinding means as employed in the wet process is undesirable because the very small amount of the developer liquid on the roller may cause patchy development or streaking. Also, while it is not impossible to expect an antiwinding effect from a modification of the surface condition of the applicator roller or from the provision of such auxiliary means as a control member or means for pressing the diazotype print releasably against the roller surfaces, those attempts give unsatisfactory results from the viewpoint of uniform and steady developer supply.

For the reasons stated, the new method in which a very small amount of developer liquid has to be uniformly transferred onto the paper being developed involves, in fact, far more difficulties in mechanically preventing the winding of the print round the applicator roller than in the wet process.

It is a principal object of the present invention to prevent the winding of the exposed print round the applicator roller in the new method through an improvement in the formula for preparation of the developer liquid. The improvement is based on a concept that has been totally overlooked in the wet process which depends on mechanical means for the prevention of the print winding.

Contingent advantages of the present invention include increased color intensity of developed prints and an enhanced lubrication effect on the applicator roller and the control member such as a doctor blade in pressure contact therewith. There is no drawback that can be an obstacle in the course of development according to the new method.

DETAILED DESCRIPTION

The formula for the preparation of developer liquid in the new method uses an organic amine or amines as an alkaline developing agent as exemplified in the published specifications of Japanese Pat. application Publication No. 23515/1970 and patent application public disclosure No. 37428/1972. Examples of the developer composition are as follows:

| | | | |
|---|---|---|---|
| Monoethanolamine | 60% | Monoethanolamine | 60% |
| Hexylene glycol | 20 | Hexylene glycol | 20 |
| Water | 20 | Cis-9-octadecenic acid | 20 |
| Monoethanolamine | 50% | | |
| | | Monoethanolamine | 60% |
| N-methylethanolamine | 10 | | |
| | | Diethylene glycol monomethyl ether | 20 |
| Triethanolamine | 10 | | |
| Methyl cellosolve | 10 | | |
| | | Diethylene glycol monoethyl ether | 17 |
| Water | 20 | | |
| | | Stearic acid | 3 |
| Monoethanolamine | 40% | Diethanolamine | 40% |
| Ethylene glycol | 30 | Diethylene glycol | 30 |
| Glycerine | 10 | 4-Methoxy-4-methylpentanol-2 | 20 |
| Water | 20 | | |
| | | Palmitic acid | 10 |

It has now been found that the addition of a small amount of a fluorocarbon non-ionic surface active agent to such a developer liquid will reduce the adhesion of the sensitized paper to the applicator roller and thereby prevent the winding of the paper round the roller. A similar attempt at preventing the paper winding round the applicator roller by an improvement in the formula for preparation of the developer liquid in the new method was proposed by us in our copending Japanese Pat. application No. 20747/1973 wherein the addition of a certain methylphenol silicone oil for that purpose is taught. The fluorocarbon non-ionic surface active agent to be used in accordance with the present invention has now been found more desirable than the methylphenyl silicone oil because of a greater initial effect, the steadily sustained antiwinding effect regardless of the deterioration of developer due to extended use, and wider applications with more stabilized solubility in varied developer compositions.

Useful fluorocarbon non-ionic surface active agents for the purposes of the invention are those having fluorocarbon groups in their molecules. The fluorocarbon groups may be straight- or branched-chain poly- or perfluoroalkyl groups or poly- or perfluorocyclic groups (e.g., perfluorocyclohexyl group) or their combinations. Among such fluorocarbon non-ionic surface active agents are, for example, those sold by Minnesota Mining & Manufacturing Company under the trade names "Fluorad FC-170," "FC-176," "FC-430." Fluorocarbon surface active agents of anionic type, e.g., "FC-96" and "FX-161," are also available from the same manufacturer, but experiments indicated that the anionic agents are less soluble in the developer with practically no reduction in the surface tension value, and achieve little antiwinding effect. The non-ionic type, by contrast, is highly soluble in the developer liquid prepared by dissolving an organic amine or amines as the alkaline developing agent in an organic solvent or solvents, and it forms less bubbles than the anionic type does. In respect of surface tension attainable, it is superior to the anionic type in that, when it is added in an amount of 0.1% by weight, the agent can remarkably reduce the surface tension value of the developer liquid, for example from 58 dyne/cm down to about 40 dyne/cm. Another advantage of the non-ionic type over the anionic type is that the latter may cause precipitation due to its reaction with some activator contained in the chemical composition with which the diazotype paper is coated, while the non-ionic type does not cause this.

In order to ascertain the life, the developers of the aforementioned compositions, each containing 0.1% of a fluorocarbon non-ionic surface active agent, were repeatedly tested for a period of six months. It was confirmed that they continue to have adequate antiwinding effect throughout the test period. The additives that fall within the domain of the fluorocarbon non-ionic surface active agents above defined are mutually soluble with the developer liquids, do not separate or precipitate with increased water contents, and are useful even if the pH of the liquids rise to 10 – 12. With respect to wetting property and permeability, the fluorocarbon non-ionic surface active agents will influence the developer liquids. In other words, the spreading of a developer liquid over the applicator roller or paper is accelerated by the addition of one such agent. Experiments revealed that, on a certain kind of paper, a drop of a developer liquid on the paper containing 0.1% by weight of the surface active agent spread in a given period of time over an area about ten times larger than the area covered by a drop of the same liquid without the addition of the agent. Naturally the former volatilized faster. As for the permeability, the addition of the surface active agent increased the permeation rate of the developer liquid dropped onto a diazotype paper by about 50%.

As described above, the addition of a very small amount of a flurocarbon non-ionic surface active agent brings physico-chemical changes (e.g., in the surface tension, wettability, permeability, and antifrothing quality) of a developer liquid, and it is considered that these changes reduce the adhesion of the paper to the applicator roller in the presence of the developer liquid. It has been confirmed by numerous experiments that the adhesion is not always primarily related to the viscosity or surface tension of the liquid. Probably the above-described physico-chemical changes materially influence the condition of the developer film formed between the paper and the applicator roller, and hence the change in the adhesion. In experiments the antiwinding effect was first observed when the amount of the surface active agent added was 0.01%. An adequate effect for the practical purpose was attained with the addition of 0.1%. Although the high solubility of the agent in the developer liquid permits a large addition, the actual amount is limited to 1% or less in view of the economy as well as the effect practically achievable. Since a very small amount of the agent proves effective, the chemical properties of the developer liquid required for the development are not in the least affected unfavorably.

The present invention is illustrated by the following examples.

EXAMPLE 1

A developer liquid prepared from

| | |
|---|---|
| Monoethanolamine | 60% |
| Diethylene glycol monomethyl ether | 20 |
| Diethylene glycol monoethyl ether | 17 |
| Stearic acid | 2.8% |
| Fluorocarbon non-ionic surface active agent ("FC-170" made by Minnesota Mining & Mfg. Co.) | 0.2 |

and a liquid of the same composition but without the fluorocarbon non-ionic surface active agent were tested for paper winding round an applicator roller in the following way. The copying machine used was Model PD2200 manufactured by Bunshodo Co., Japan. It comprised a rubber roller with minute indentations on the surface and a wiper blade pressed against the roller surface to allow the roller to carry the developer liquid in a controlled amount of not more than 3 grams per square meter so that the liquid is transferred onto a sheet of copying paper at the controlled rate. The paper used weighed 30 kg per 1000 sheets (each sheet being 0.045 mm thick). The rate of developer application was adjusted to 1.6 g/m². The tests were conducted at a room temperature of 27° C and a humidity of 80%. First, 10 sheets were passed at a constant feed rate through the developing zone of the copying machine, and the frequency of winding of the paper round the applicator roller was counted. The same procedure was repeated at varied feed rates. The results obtained are tabulated below.

| Speed setting of machine | Paper feed rate (m/h) | Developer liquid of composition of Example 1 | Developer liquid without surface active agent | |
|---|---|---|---|---|
| 10 | 105 | No winding | No winding | |
| 12 | 126 | " | Wind freqcy. | 20% |
| 14 | 144 | " | " | " |
| 16 | 168 | " | " | " |
| 18 | 192 | " | " | 40 |
| 20 | 216 | " | " | 80 |
| 22 | 237 | " | " | 100 |
| 24 | 261 | " | " | " |
| 26 | 282 | " | " | " |

-continued

| Speed setting of machine | Paper feed rate (m/h) | Developer liquid of composition of Example 1 | Developer liquid without surface active agent | |
|---|---|---|---|---|
| 28 | 306 | " | " | " |
| 30 | 330 | " | " | " |
| 32 | 348 | " | " | " |
| 34 | 375 | " | " | " |
| 36 | 393 | " | " | " |
| 38 | 396 | " | " | " |
| 40 | 402 | " | " | " |

It will be seen from the results that the addition of a fluorocarbon non-ionic surface active agent confers a stable antiwinding effect upon very thin paper.

Under the same conditions, when the paper was exposured to light and developed in the usual manner, it was color developed satisfactorily. There occurred no mechanical irregularity in the copying machine.

EXAMPLE 2

A developer liquid consisting of

| | |
|---|---|
| Monoethanolamine | 60% |
| Hexylene glycol | 20 |
| Water | 19 |
| Fluorocarbon non-ionic surface active agent ("FC-430" made by Minnesota Mining & Mfg. Co.) | 1 |

and a liquid of the above composition minus the surface active agent were subjected to tests in the same manner as described in Example 1. Effects similar to those achieved in the preceding example were confirmed.

EXAMPLE 3

A developer liquid consisting of

| | |
|---|---|
| Monoethanolamine | 40% |
| Ethylene glycol | 30 |
| Glycerine | 10 |

-continued

| | |
|---|---|
| Water | 19.9 |
| Fluorocarbon non-ionic surface active agent ("FC-176" made by Minnesota Mining & Mfg. Co.) | 0.1 |

and a liquid of the same composition minus the surface active agent were tested in the same way and results similar to those in Example 1 were obtained.

What is claimed is:

1. A developer liquid for use in a development system using developer liquid applicator roller means wherein the liquid is supplied from said roller means to an exposed diazotype paper at a rate of not higher than 3 $g/m^2$, said developer liquid consisting essentially of a mixture containing, one or more organic amines in a quantity adequate to develop an azo dye image in said diazotype paper, a diluent, and an additive of 0.01 to 1% by weight of a fluorocarbon non-ionic surface active agent based on the total weight of the mixture; said fluorocarbon non-ionic surface active agent being a compound selected from the group consisting of straight chain alkyl fluorocarbons, branched chain alkyl fluorocarbons, perfluoroalkyl fluorocarbons, and perfluorocyclic fluorocarbons.

2. A developer liquid for use in a development system using developer liquid applicator roller means wherein the liquid is supplied from said roller means to an exposed diazotype paper at a rate of not higher than 3 $g/m^2$, said liquid consisting essentially of a mixture of a fluorocarbon non-ionic surface active agent in a solution of a diluent and one or more organic amines as a developing agent, the non-ionic surface active agent being present in the amount of from .01 to 1% of the total weight of said liquid and said organic amines comprising not less than 20% of the total weight of said liquid; said fluorocarbon non-ionic surface active agent being a compound selected from the group consisting of straight chain alkyl fluorocarbons, branched chain alkyl fluorocarbons, perfluoroalkyl fluorocarbons, and perfluorocyclic fluorocarbons.

* * * * *